US008893456B2

(12) United States Patent
Sullivan et al.

(10) Patent No.: US 8,893,456 B2
(45) Date of Patent: Nov. 25, 2014

(54) METHOD AND APPARATUS FOR PROCESSING ENVELOPES CONTAINING DOCUMENTS TO OBTAIN IMAGES OF THE DOCUMENTS

(75) Inventors: Michael Sullivan, Florence, NJ (US); Erick Grasmueck, Voorhees, NJ (US); David Helmlinger, Mount Laurel, NJ (US); Robert R DeWitt, Marlton, NJ (US); George L Hayduchok, Mount Holly, NJ (US)

(73) Assignee: Opex Corporation, Moorestown, NJ (US)

( * ) Notice: Subject to any disclaimer, the term of this patent is extended or adjusted under 35 U.S.C. 154(b) by 391 days.

(21) Appl. No.: 12/863,711

(22) PCT Filed: Oct. 28, 2009

(86) PCT No.: PCT/US2009/062368

§ 371 (c)(1),
(2), (4) Date: Jul. 20, 2010

(87) PCT Pub. No.: WO2010/062648

PCT Pub. Date: Jun. 3, 2010

(65) Prior Publication Data

US 2011/0206235 A1 Aug. 25, 2011

Related U.S. Application Data

(60) Provisional application No. 61/108,984, filed on Oct. 28, 2008.

(51) Int. Cl.
*B65B 43/00* (2006.01)

(52) U.S. Cl.
USPC ..... 53/381.3; 53/381.2; 53/381.5; 53/492

(58) Field of Classification Search
USPC ..... 53/381.1, 381.2, 381.3, 492, 381.5
See application file for complete search history.

(56) References Cited

U.S. PATENT DOCUMENTS

| | | | | | |
|---|---|---|---|---|---|
| 4,525,986 | A | * | 7/1985 | Noll | 53/569 |
| 5,054,620 | A | * | 10/1991 | DeWitt et al. | 209/3.1 |
| 5,054,700 | A | * | 10/1991 | DeWitt | 241/101.4 |
| 5,524,876 | A | * | 6/1996 | Porter | 271/178 |
| 5,857,830 | A | * | 1/1999 | Harres et al. | 414/798.9 |
| 5,947,468 | A | * | 9/1999 | McKee et al. | 271/210 |
| 6,135,697 | A | * | 10/2000 | Isaacs et al. | 414/281 |
| 6,897,394 | B1 | | 5/2005 | DiBiaso et al. | |

FOREIGN PATENT DOCUMENTS

WO 2004/111780 12/2004

* cited by examiner

*Primary Examiner* — Christopher Harmon
(74) *Attorney, Agent, or Firm* — Stephen H. Eland; Dann, Dorfman, Herrell & Skillman

(57) ABSTRACT

A method and apparatus for processing mail is provided. Mail is placed into an input been having a conveyor that conveys the mail towards a feeder. The feeder serially feeds the envelopes to a cutter that severs the top edge of the envelopes. A transport conveys the envelopes from the top cutter to an extractor. The extractor opens the edge-severed mail and presents the contents of the envelopes to an operator who manually extracts the contents. From the extractor, the operator manually feeds the extracted documents to a document input. From the document input, the documents are fed to a document transport that conveys the documents past an imaging module to obtain image data for the documents before sorting the documents to output bins.

13 Claims, 8 Drawing Sheets

METHOD AND APPARATUS FOR PROCESSING ENVELOPES CONTAINING DOCUMENTS TO OBTAIN IMAGES OF THE DOCUMENTS

RELATED APPLICATIONS

This application is a 371 application of International Application No. PCT/US09/62368 filed Oct. 28, 2009, which claims priority to U.S. Provisional Application No. 61/108,984 filed Oct. 28, 2008. The entire disclosure of each of the foregoing applications is herein incorporated by reference.

FIELD OF THE INVENTION

The present invention relates to the field of processing mail. More specifically, the present invention relates to a workstation operable to process envelopes containing contents by presenting opened envelopes to an operator so the operator can extract the contents from the envelopes and obtain image data for the documents.

BACKGROUND

Automated and semi-automated machines have been employed for processing documents such as bulk mail. Due to the large quantity of mail received by many companies, there has long been a need for efficient processing of incoming mail. Document sorting has become particularly important in the area of remittance processing.

Utility companies, phone companies, and credit card companies routinely receive thousands of payment envelopes from their customers on a daily basis. Typically, a customer payment envelope contains an invoice stub and some type of customer payment, usually in the form of a bank check or money order. Fully automated systems automatically open such mail, extracts the contents, sort the contents and scan the contents to obtain image data for each document in the contents.

Frequently, the envelopes received in the incoming mail have varying characteristics. For instance, the height, length and thickness of the envelopes may vary. Many fully automated mail processing systems are unable to process such mail so it is outsorted for manual processing. It is desirable to provide a system to efficiently process such mail and obtain image data for such documents.

In accordance with the present invention, an apparatus and method are provided for processing mail that can accommodate a batch of mail containing envelopes having different characteristics.

SUMMARY OF THE INVENTION

In light of the foregoing, a workstation is provided for processing a stack of mail including envelopes having contents. The envelopes are serially fed from an input bin into an envelope path. One or two of the edges of the envelopes are severed and the envelopes are presented to an operator who manually extracts the contents from the envelopes.

After manually extracting the contents, the operator feeds the contents to a document feeder. The contents of an envelope form a single transaction, and the documents are fed to the document feeder so that the system processes each transaction separately.

The documents are optionally conveyed past a MICR detector that reads the MICR line on documents, such as checks. From the document feeder, the documents are serially fed to a document transport that conveys the documents past an imaging module that scans the documents to obtain image data for each document. Additionally, the documents may be conveyed past a pair of printers that print information on each document, and the documents are then sorted to one or more output bins.

These and other aspects of the present invention are described in greater detail in the accompanying detailed description.

DESCRIPTION OF THE DRAWINGS

The foregoing summary and the following detailed description of the preferred embodiments of the present invention will be best understood when read in conjunction with the appended drawings, in which.

DETAILED DESCRIPTION OF THE INVENTION

Figure 1:
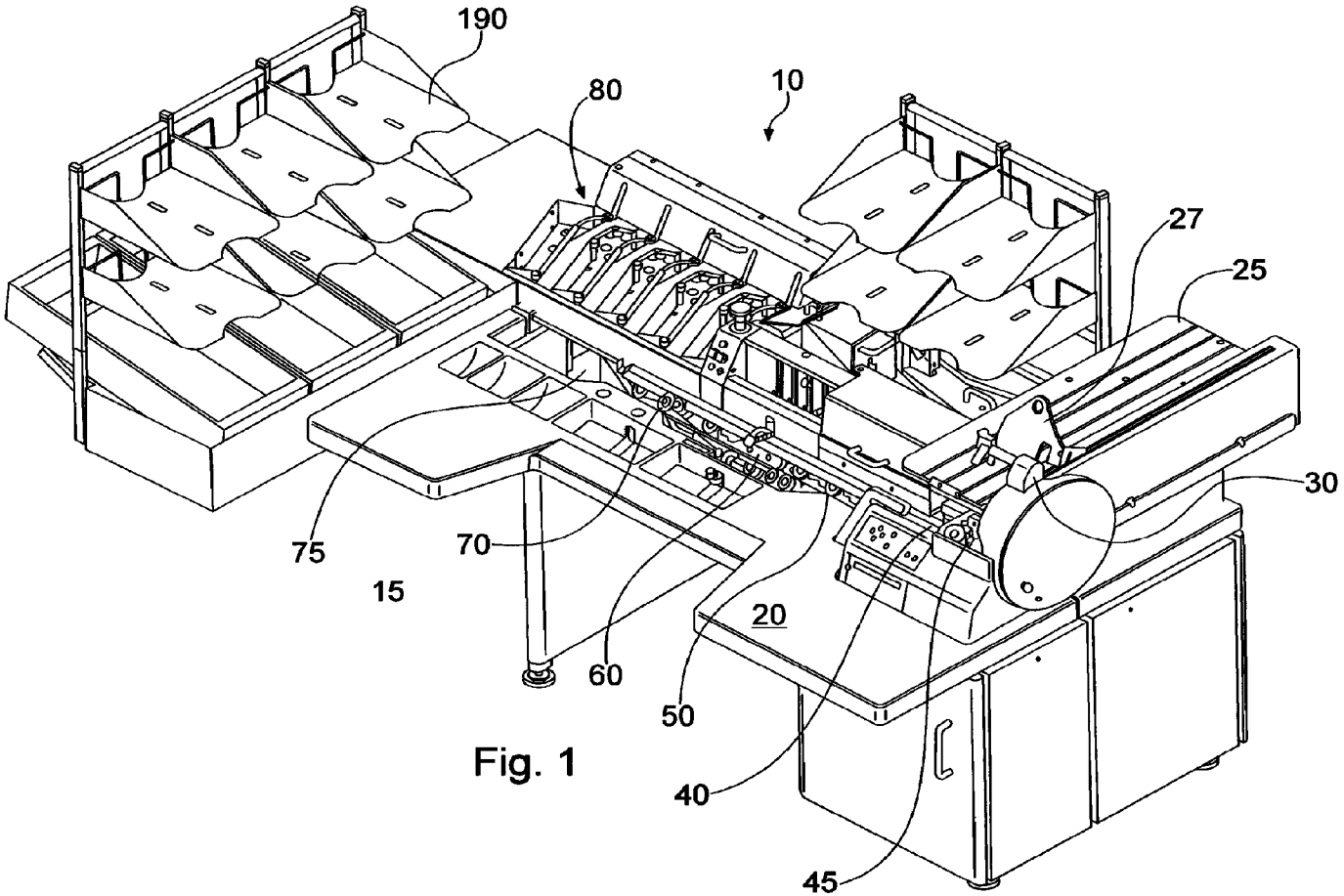
FIG. 1 is a perspective view of a semi-automated mail processing station in accordance with the present invention.

Referring now to the figures in general and to FIG. 1 in particular, a semi-automated mail processing workstation 10 is illustrated. The workstation 10 includes two sections: the first is a mail extraction system 20 for extracting documents from envelopes; the second is an imaging/sorting module 80 for scanning the extracted documents and optionally sorting the documents. The mail extraction system 20 processes mail by severing one or more edges of each envelope in a stack of mail, and presenting the edge-severed envelopes one at the time to an operator who removes the documents from the envelope by hand. The operator can then drop the extracted documents into the input bin of a document feeder that separates the documents, serially feeding the documents to a document transport for the imaging/sorting module 80. The documents are then optionally sorted into one or more output bins.

Brief Overview

A general overview of the flow of mail is as follows. Initially, a stack of envelopes containing documents, referred to as a job, is placed into an input bin 25 having a support 27 that supports the stack of mail. A feeder 30 removes the lead envelope 5 from the front of the stack and transfers the envelope to a feed tray 40.

The envelope 5 in the feed tray is edge-justified by a plurality of opposing rollers. From the feed tray 40, the envelope 5 drops past a side cutter 45, which severs the side edge of the envelope if desired. From the side cutter 45, the envelope drops into a shuttle. The shuttle moves vertically to adjust the height of the top edge of the envelope to account for variations in the height of the different envelopes in the job. The shuttle moves vertically until the height of the top edge of the envelope 5 is within an acceptable range for advancing the envelope into a top cutter. The envelope is then transported to the top cutter, which severs the top edge of the envelope 5.

From the top cutter the envelope is advanced to an extraction station 60. The extraction station 60 pulls apart the front and back faces of the envelope to present the contents of the envelope for removal. An operator then manually removes the contents from the envelope 5.

After the operator removes the documents from the envelope 5, the apparatus 10 automatically advances the envelope to a verifier 70. The verifier 70 verifies that all of the documents were removed from the envelope before the envelope is discarded. From the verifier 70 the envelope is conveyed into a waste container. Alternatively, the envelope 5 may be manually removed and fed into the imaging system/sorting module 80.

Returning to the flow of the documents, after the operator extracts the documents at the extraction station 60, the operator input the documents into a document imaging/sorting module 80 that scans an image of each document and then sorts each document. Specifically, the operator unfolds the extracted documents as needed and drops or places the documents into an input bin 100 of an imaging entry feeder 90 that feeds the documents toward an imaging station 160. The imaging entry feeder 90 receives the documents from the operator and controls the feeding of the documents to the imaging station 160. The imaging entry feeder 90 is configured to receive and feed documents of various sizes and condition. For instance, frequently documents are folded in an envelope. When the documents are extracted and opened up, the documents are creased or folded so that they do not lie flat. The feeder 90 is preferably configured to receive variously sized documents and creased or folded documents, and serially feed the documents to a document transport 150 that transports the documents to the imaging station 160 with minimal manual preparation by the operator.

The imaging station 160 scans the documents to obtain image data for each document as the document is conveyed past the device. For instance, preferably the imaging station 160 is a contact image sensor that obtains gray scale or color image data representing an image of each document. The contact image sensor scans each document at a plurality of points as the document is conveyed past the contact image sensor. The information for each document is stored in a data file for each document so that the image data can be accessed at a later time.

From the imaging station, the document transport 150 conveys the documents through a delay path to allow sufficient time for sorting decisions based on both data gathered from each document as well as combined data to make transaction decisions.

From the delay path section, the document transport 150 conveys the documents to a sorting station 180 that sorts the documents into a plurality of output bins 182, 184, 186, 188. The documents can be sorted in a variety of ways. For instance, the documents can be sorted based on document information obtained from the image data received at the imaging station 160. Alternatively, the operator may indicate information regarding a document before it is scanned, so that the document is sorted according to the information indicated by the operator. Yet another alternative is that the documents may be stacked into one or more bins simply based on the order in which the documents are processed.

A controller controls the processing of the mail in response to signals received from various sensors at various locations of the workstation 10 and in response to parameters set for the job by the operator. For instance, in response to an indication from a sensor in the feed tray that there is no envelope in the feed tray, the controller sends a signal to the feeder 30 indicating that an envelope should be fed from the input bin to the feed tray.

Configuration of the Work Station

As can be seen in FIG. 1, preferably the work station 10 is configured so that an operator working at the workstation has ready access to each working area. A seating area 15 at the front of the apparatus is centrally located, and the different stations are disposed around the seating area with the paper path flowing in a manner that the documents remain within easy access of the operator at the seating area.

Specifically, preferably, the feeding station 30 is disposed adjacent the right side, however, the feeding station can be located on the left side if desired. Preferably, the feeding station is within arm's reach of the operator from the seating area 15. Accordingly, preferably the distance from the seating area to the feeding station is no longer than one half the overall width of the work station, so that the operator can readily access the feeding station 30 from the seating area. From the feeding station 30, the mail pieces are fed along a document path that extends across the workstation along the width of the work station, intermediate the front and rear edges of the work station to the extraction station 60. Preferably, the extraction station is substantially aligned with the seating area 15 relative to the right and left edges of the work station so that the operator can readily grasp the mail at the extractor during operation. For instance, preferably the extraction station is generally centered between the right and left edges of the workstation, and preferably the center of the seating area is also generally centered between the right and left edges of the work station. In other words, preferably the seating area is disposed a distance from the left hand edge of the work station that is substantially similar to the distance that the extraction station is disposed from the right hand edge of the work station.

The imaging entry feeder 90 is preferably located adjacent to the front edge of the work station, and is disposed immediately rearwardly of the extraction station 60 and the seating area 15 so that the operator can simply pull the documents out of an envelope and reach forward slightly to drop the documents into the imaging entry feeder 90.

Details of the Stations

Feeding and Edge Cutting Stations

The envelope feeding station includes an input bin 25 and a feeder 30. The input bin is configured to receive a stack of mail and convey it to the feeder. The feeder 30 comprises a pivoting arm with a suction cup that grasps an envelope from the stack of mail and transports the piece to a side cutting station. In this way, the feeder 30 serially feeds mail from the stack of mail.

The side cutting station includes a plurality of drive rollers and opposing idler rollers. As the envelope passes between the rollers a rotary knife severs the trailing side edge of the envelope. The severed edge drops down a scrap chute into a waste container.

From the side cutting station, the envelopes are top edge-justified so that the top edge remains at a consistent height. In order to accommodate a variety of envelopes, the apparatus may include a shuttle that moves up and down to position the top edge of each envelope at approximately the proper height. The shuttle is a bin that receives each envelope and moves up or down as necessary to adjust the height of the top edge of each envelope as necessary depending upon the height of each envelope.

After the envelopes are top edge-justified, the envelopes are conveyed to a top cutting station that severs the top edge of the envelopes. In this way, the top and trailing edge of each envelope are cut by the two cutting stations. Optionally, the side cutting station can be configured so that both sides of each envelope are severed. Yet another option is to eliminate or disable the side cutters so that only the top edge of the envelopes is opened.

Extraction Station

The extraction station 60 operates to pull apart the faces of the edge-severed envelopes and present the contents so that an operator can easily remove the documents. After the operator removes the contents, a sensor sends a signal to the controller that the contents have been extracted. The empty envelope is then transported to the verification station 70 and another envelope is fed to the extraction station 60.

Figure 3:
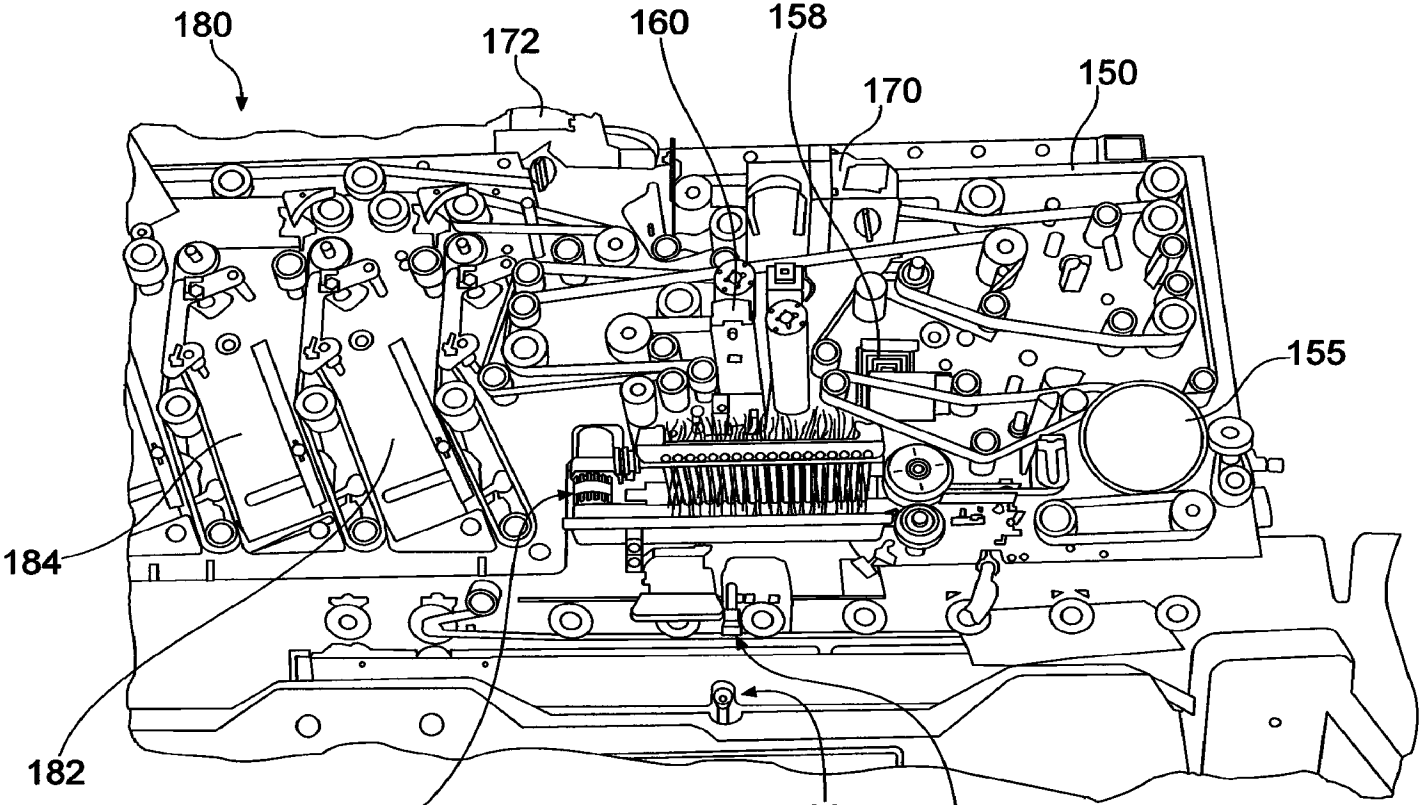
FIG. 3 is a fragmentary plan view of the mail processing station illustrated in FIG. 1.
Figure 6:
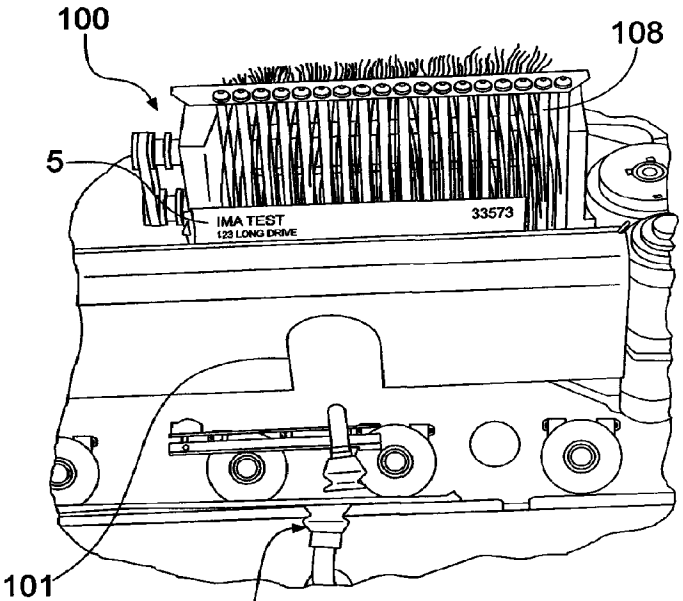
FIG. 6 is a fragmentary perspective view of the extraction station and imaging entry feeder of the mail processing station illustrated in FIG. 1.

Referring now to FIG. 6, the extraction station 60 includes a pair of opposing vacuum suction cups 64 mounted on two pivotal extractor arms 62. The suction cups 64 are connected to a vacuum pump. The extractor arms 62 are operable in two alternative positions. In the first position, the extractor arms are pivoted away from one another, as shown in FIG. 3. In the second position the extractor arms are pivoted toward one another, as shown in FIG. 6.

As shown in FIG. 1 the extraction station 60 is positioned in front of the seating area 15 intermediate the front and rear edges of the work station. Before an envelope enters the extraction station, the extractor arms 62 are pivoted away from one another. When the envelope enters the extractor, the arms 62 pivot toward one another and negative pressure is supplied to the suction cups so that the suction cups engage the faces of the envelope. The arms then pivot away from one another pulling apart the faces of the envelope, which have been severed along the top edge and preferably the side edge. The operator can then remove the contents of the envelope.

The horizontal envelope transport 50 pinches the envelope between idler rollers and a belt. Therefore, when the extractor arms 62 pull apart the faces of the envelope, the envelope and its contents remain pinched between the idler rollers and the belt. The extraction station 60 is preferably includes a sensor 66 for detecting whether the contents have been removed from the envelope. The sensor may be an optical sensor for detecting the presence of documents when the operator removes the documents from the envelope. Alternatively, the sensor may be a thickness detector that detects the thickness of the envelope before and after the documents are removed to determine whether documents have been removed.

Verification Station

The verification station 70 checks the thickness of each envelope to ensure that all of the contents have been removed from the envelope before the envelope is discarded into a waste chute 75. The verifier 70 can use an optical sensor to check the thickness of the envelope, however, in the present instance, the verifier preferably checks the thickness of the envelope by measuring the distance between the outer surfaces of the envelope faces.

If the verifier 70 measures a thickness that is greater than a reference value, then a signal is sent to the controller indicating that the envelope in the verifier 70 is not empty. An indicator light is lit indicating to the operator that the envelope at the verifier should be removed and checked to ensure that all of the contents were removed. A verifier sensor adjacent the thickness detector detects the presence of the envelope in the verifier 70. Until the operator removes the envelope from the verifier, the document transport will not advance any envelopes, regardless of whether the envelope in the extraction station 60 is empty.

Although the foregoing description provides the details of a system for opening envelopes and presenting the contents to an operator, including the envelope feeder, envelope cutters and extraction station used in the present instance, it should be understood that this configuration is an exemplary embodiment. The system may include other configurations of systems for opening envelopes and presenting the contents to an operator so that the operator can manually remove the contents. For instance, an alternate envelope feeder and opening station is disclosed in U.S. patent application Ser. No. 10/348,358, published as Published Application no. 2005/0097867 on May 12, 2005. The feeding stations and edge cutting area described in application Ser. No. 10/348,358 could be incorporated into the present apparatus in place of the feeding and edge cutting stations described above. The entire disclosure of application Ser. No. 10/348,358 is hereby incorporated herein by reference.

The following description discusses the processing and imaging of documents that have been extracted from opened envelopes in the manner discussed above. However, in certain applications, the apparatus is operable to process documents without using the extraction features of the apparatus. For instance, the apparatus may be used to process a batch of documents that have been previously extracted, such as documents that are rejected by high speed automated processing devices. For such documents it is advantageous to use the feeding and scanning features as discussed below. Similarly, a batch of pre-slit mail may be processed, whereby the operator manually opens the slit envelopes and then processes the documents as discussed further below. Accordingly, unless otherwise noted below, the following discussion of the document imaging process is applicable to a variety of applications in which a batch of documents needs to be imaged, without regard to how the documents are obtained (i.e. the documents are provided in a stack as opposed to documents that must be extracted from envelopes). Features of the present invention are not limited to applications in which the envelope opening and extraction features of the apparatus are used.

Imaging/Sorting Module

The system 10 includes an imaging/sorting module 80 for scanning the extracted documents to obtain image data for the documents and optionally sorting the documents into a plurality of bins. The imaging/sorting module 80 is positioned rearwardly from the horizontal transport 50. In the present instance, the imaging/sorting module 80 includes a document transport 150 comprised of a plurality of opposing belts that are driven by a plurality of rollers. Sufficient distance between the imaging/sorting module 80 and the printers and sort bins has been provided to allow time for transaction level decisions to be made before printing and sorting. The system shown allows sufficient time and space for 3 piece transactions to be processed as a transaction, but increased distance could be provided to handle almost any size transaction. The documents are engaged between the opposing belts and move as the belts are driven forwardly.

Figure 2:
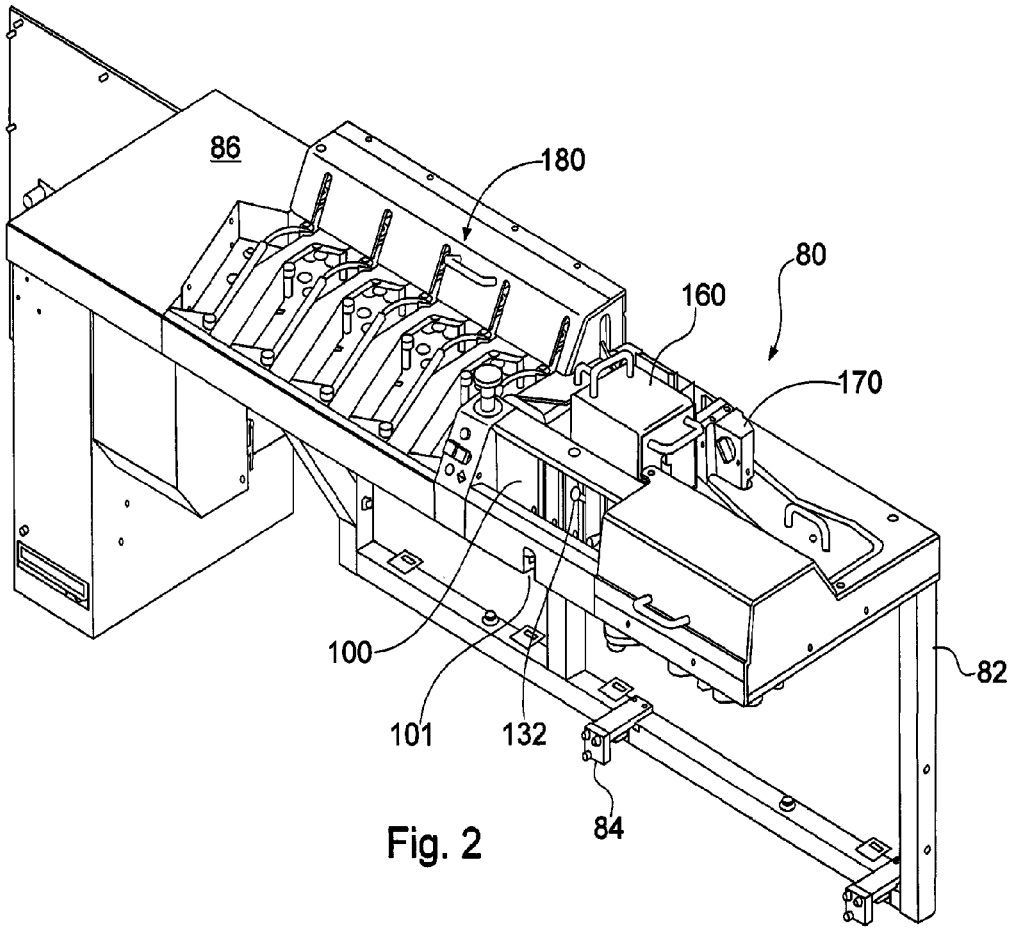
FIG. 2 is a perspective view of a imaging/sorting module of the mail processing station illustrated in FIG. 1.

The imaging/sorting module 80 may be integrally formed with the envelope feeder and extraction station 60. However, in the present instance, the imaging/sorting module 80 is a separate unit that may be retrofitted onto existing envelope opening stations, as shown in FIG. 2. Accordingly, the imaging/sorting module 80 includes a frame 82 having an upper generally horizontal top surface 86. The imaging entry feeder 90, document transport 150 and imaging station 160 are mounted to the top surface 86.

The frame includes a plurality of connectors 84 for connecting the imaging/sorting module to the frame of an extraction workstation. Such an extraction workstation has an upper work surface located behind an extraction station, such as the extraction station described above. The extraction workstation also includes the horizontal envelope transport 50, along with the envelope feeder and envelope cutters 45. By mounting the imaging/sorting module 80 on a separate frame, the entire imaging/sorting module can be mounted onto the top surface of an extraction workstation and rigidly connected to the workstation.

When configured as a separate module as shown in FIG. 2, the imaging/sorting module may be configured to cooperate with the extraction station so that the document input bin 100 is positioned closely to the extraction station. Specifically, as shown in FIG. 2, the front of the input bin may include a recess 101 configured to accommodate one of the extractor arms. In this way, the input bin can be positioned close enough to the extraction station and the operator to provide easy and efficient placement of contents into the document input bin after the operator extracts the documents at the extraction station.

Referring now to FIGS. 3-9, the details of the document imaging/sorting module 80 will be described in greater detail. As shown in FIG. 3, the imaging entry feeder 90 is the entry point for the documents after the operator extracts the documents at the extraction station. The imaging entry feeder 90 is configured to receive one or more documents and move the documents toward a document transport 150 to convey the documents to the imaging station 160.

The imaging entry feeder 90 is designed so that documents can be easily fed into the imaging/sorting module with minimal or no document preparation by the user. Specifically, in many known manual document imaging systems, the operator must ensure that the documents are in a particular orientation and the operator needs to arrange multiple documents in an aligned stack so that the documents can be fed into the imaging station. In the present instance, the imaging entry feeder is configured to eliminate such preparation, thereby speeding up the overall processing of the system.

Accordingly, the imaging entry feeder 90 includes a document input bin 100 having a front wall 102 and a rear wall 104. The front and rear wall are generally vertical walls extending upwardly. The front wall 102 is generally parallel to and spaced apart from the rear wall 104, thereby forming an enlarge slot or chute for receiving documents. The distance between the front wall and rear wall is less than the height of the documents to be processed by the system. In this way, the input bin forms a chute for receiving the documents in a generally vertically orientation. If the documents are in a generally horizontal orientation, they will not fit within the input bin, in the present configuration.

In the present instance, the top edge of the front wall is beveled or angled toward the extraction station. Additionally, the right side of the front wall from the perspective of FIG. 4 is the lead end of the document input bin, and the lead end of the front wall angles inwardly toward the rear wall, forming a deflector 103.

The rear wall 104 is a generally vertical wall having one or more vertically elongated slots 108. The rear wall may be a generally planar wall into which the slots are formed. Alternatively, the rear wall may be formed of a plurality of vertical elements spaced apart from one another to form the vertical slots 108. For instance, as shown in FIG. 4, the rear wall may be formed from a plurality of vertical columns or rods that are spaced apart from one another to form the vertical slots. The rounded columns reduce that likelihood that an edge of a document may become snared in one of the slots 108.

A horizontal feed belt 120 is positioned to receive documents that are inserted into the document input bin 100 between the front and rear walls 102, 104. In the present instance, the feed belt 120 is positioned so that at least a portion of the feed belt is below that gap formed between the front and rear walls of the input bin. The feed belt 120 operates as a conveyor belt having a generally horizontally upper surface.

Figure 4:
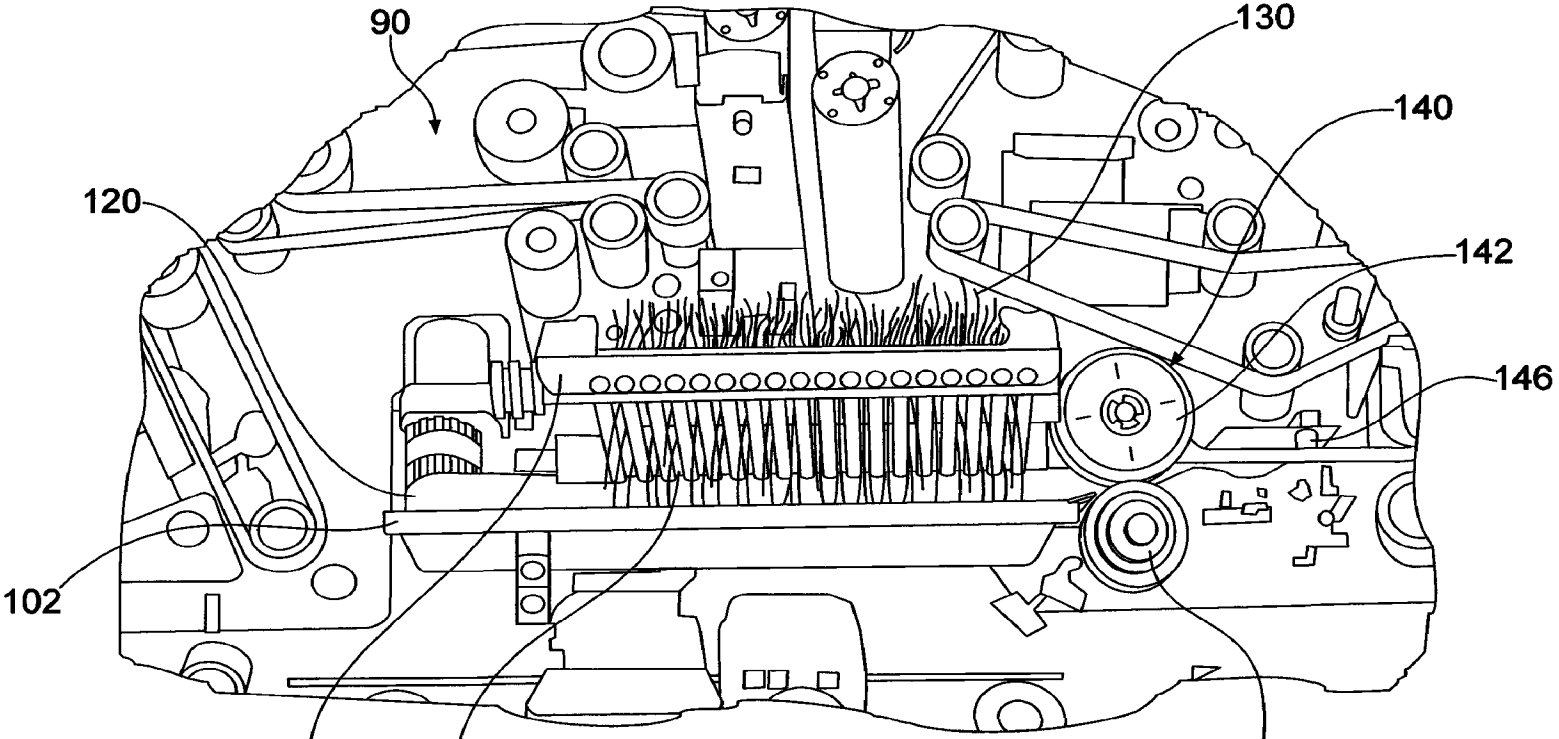
FIG. 4 is an enlarged perspective view of an imaging entry feeder of the mail processing station illustrated in FIG. 1.
Figure 5:
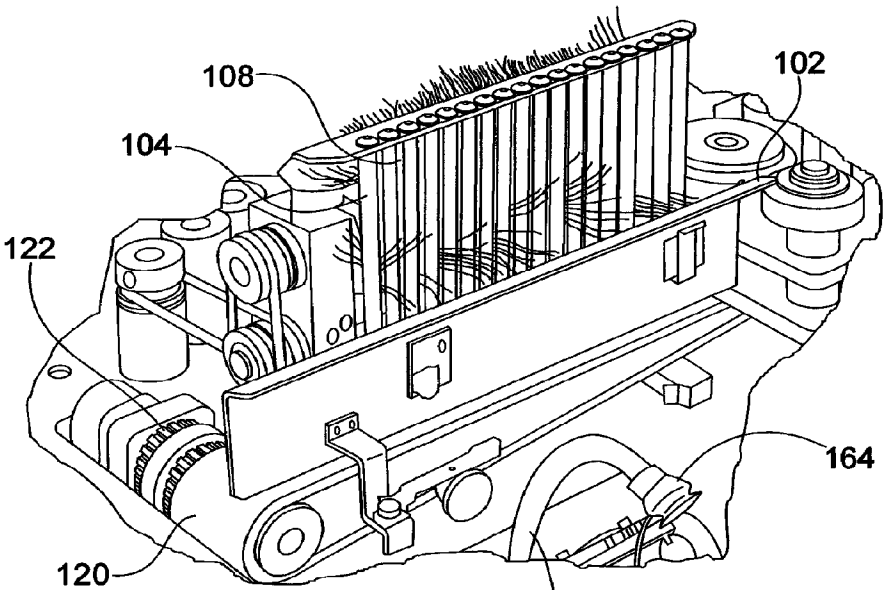
FIG. 5 is an alternate perspective view of the imaging entry feeder illustrated in FIG. 4.

In the present instance, the feed belt is an elastic belt with a grooved profile, as shown in FIGS. 4-5. The feed belt 120 is driven by a crowned pulley 122, which controls the driving of the feed belt. Although the present embodiment uses a belt as a feed belt, it should be understood that the feed belt need not be a belt. Instead, the belt can be one of a variety of conveyors operable to urge the documents forwardly. For example, driven rollers could be used rather than a belt, so that the roller would engage the bottom edge of the documents and drive the documents forwardly.

Although the system may include a sensor for detecting whether a document is present in the input bin, in the present instance, the input bin is configured to allow the operator to readily observe whether documents are in the input bin. Specifically, in the present instance, the front wall 102 is shorter than the rear wall 104. Further, the front wall is shorter than the minimum height of the typical document that is to be processed. Accordingly, as shown in FIG. 6, the input bin is configured so that the documents are readily visible to the operator when the documents are located within the document input bin. This quick visual indicator allows the operator to determine whether the operator should insert additional documents into the input bin or not.

As noted previously, the system 10 may be used to process mail that contains a variety of contents, including documents that have been folded. In order to obtain images of folded documents, the operator unfolds the documents prior to inserting the documents into the document input bin 100. However, the unfolded documents frequently may tend to "re-bound" or return toward the folded configuration when the operator places the unfolded documents into the input bin. Such partially folded documents may get caught on the walls of the input bin and not properly settle down onto the feed belt 120.

In order to improve the settling of the documents, in the present instance, a settling element 130 is provided in the input bin 100. The settling element 130 aids in urging the documents down toward the feed belt. For instance, as shown in FIGS. 4-5, the settling element may be a displaceable brush 130 having a plurality of elongated bristles that project into the input bin. The bristles engage the documents and urge the documents downwardly toward the feed belt.

In the present instance, the bristles of the brush 130 extend across at least half of the width of the input bin, and more specifically, the bristles extend across substantially the entire width of the input bin. The brush bristles extend through the vertical slots in the rear wall 104 of the input bin to engage the documents in the bin. If the settling element imparts excessive downward force on the documents, the documents may tend to buckle, thereby leading to potential document jams. Accordingly, in the present instance, the settling element 130 comprises a plurality of elongated readily deformable elements in the form of the brush bristles. The bristles readily deform when they engage the documents, thereby limiting the likelihood of the documents buckling.

Figure 7:
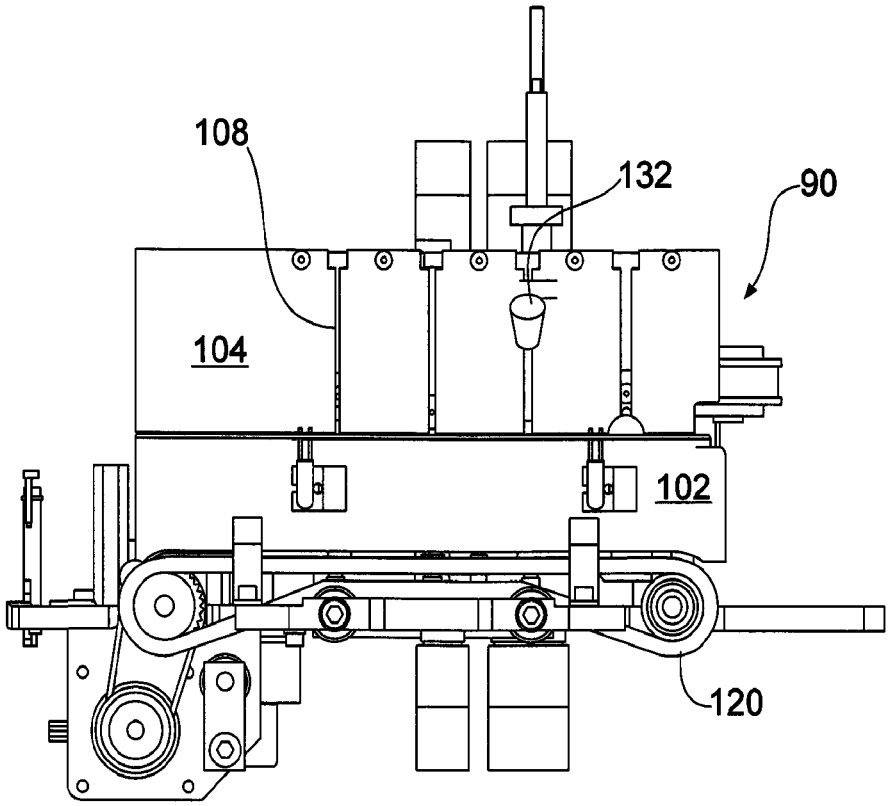
FIG. 7 is a fragmentary front elevational view of the imaging entry feeder illustrated in FIG. 4.
Figure 8:
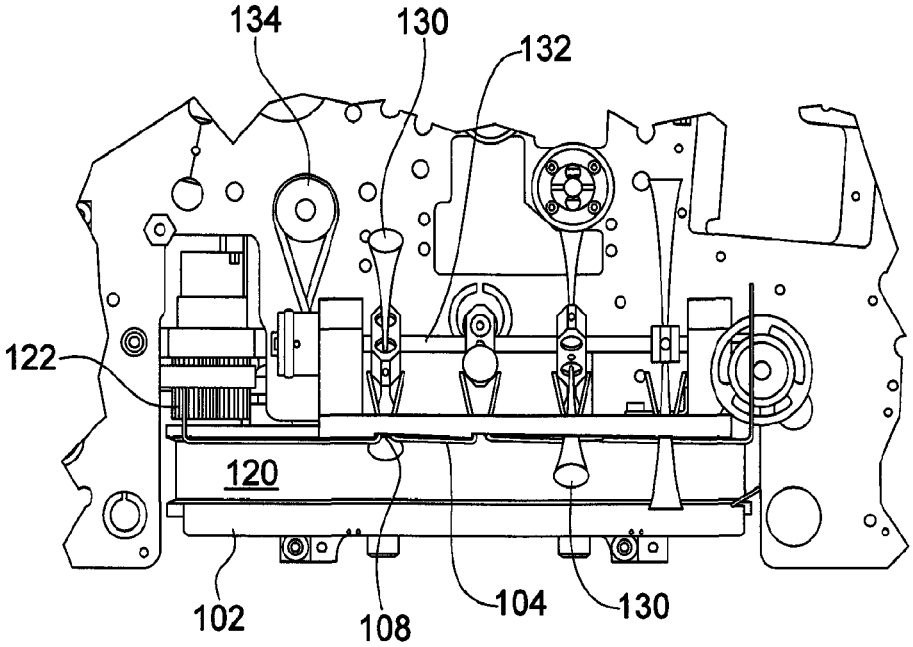
FIG. 8 is a fragmentary plan view of the imaging entry feeder illustrated in FIG. 4.
Figure 9:
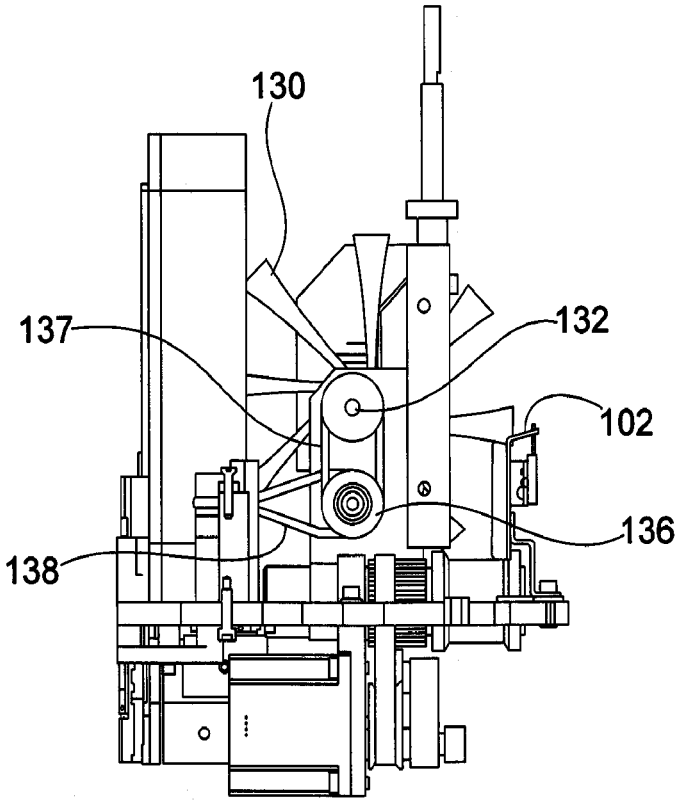
FIG. 9 is a left side view of the imaging entry feeder illustrated in FIG. 4.

The settling element is a displaceable element that urges the documents downwardly. As mentioned above, in the present instance, the settling element is a brush having elongated bristles. As shown in FIGS. 5 and 7-9, the brush 130 is a rotatable brush mounted on a drive shaft 132. The brush comprises a plurality of bristles 131 extending radially from the shaft 132. The brush may include a plurality of circumferentially spaced apart bristles, as shown in FIG. 9. Additionally, the brush may include a plurality of bristles 131 spaced apart along the length of the shaft. In this way, a plurality of bristles project into the input bin along the length of the input bin. The bristles may be spaced around the hub of the brush as individual bristles, such as shown in FIGS. 4-6, or the bristles may be grouped together in tufts that are spaced around the brush as shown in FIGS. 7-9. Further still, although the present embodiment utilizes a rotary brush having bristles to settle the documents, alternative elements can be used. For instance, the settling element may use a plurality of narrow strips or flaps of flexible material. As the settling element rotates, the flaps urge the documents downwardly. Accordingly, the settling element may comprise any of a number of elongated resiliently deformable elements that will tend to deflect the documents downwardly without buckling the documents.

As shown in FIG. 5, the drive shaft 132 for the brush 130 is connected to a driven pulley 136, which in turn is connected to a drive pulley 134. A first drive belt 137 connects the shaft 132 to the driven pulley 136. A second drive belt 138 connects the driven pulley 136 to the drive pulley 134.

Referring to FIG. 4, a pair of rollers 142, 144 are positioned adjacent the discharge end of the input bin 100, which in the present instance is the right side of the input bin from the perspective of FIG. 4. The rollers 142, 144 form a nip of a singulator 140 that is operable to singulate the documents in the input bin 100, as discussed further below. Additionally, the rollers 142, 144 operate to justify the forward edge of the documents in the transaction. Specifically, the feed belt 120 drives the documents in a transaction forwardly until the leading edge of the transaction engage one or both of the rollers 142, 144. In the present instance, the singulator rollers 142, 144 are not started until the transaction engages the rollers, so that the rollers justify the leading edge of the transaction.

The two rollers have high coefficients of friction. The larger diameter roller 142 is driven in reverse and has a torque limiting clutch mounted functionally between the drive shaft and roller hub. Accordingly, the larger roller 142 operates as a retard roller that holds back all but the first document to be fed, while the smaller roller operates as a feed roller to serially drive each document to be fed into the document transport 150. A feed sensor 146 is positioned between the singulator 140 and the entry nip of the document transport 150.

The feed sensor 146 is operable to detect the presence of a document. Specifically, the feed sensor detects transitions between documents. For instance, the feed sensor may be an ultrasonic detector that detects transitions from paper to air, which is representative of a transition from a document to no document (i.e. a gap between documents). Based on the signal from the feed sensor, the singulator 140 feeds the next document toward the document transport. Additionally, the document transport 150 operates at a higher speed than the document speed at the singulator 140 so that a gap is formed between each piece being fed. Additionally, the system controls the paper to maintain the proper gap between documents by slowing down or speeding up the document transport.

From the singulator 140, the document transport 150 serially conveys the documents to a justifier 155 that aligns the lower edge of the documents so that the lower edge is at a known height. From the justifier 155 the documents may be conveyed to a MICR reader 158 positioned along the document transport 150. The MICR reader is operable to read characters that are printed in magnetic ink, such as the MICR line on checks. From the MICR reader, the documents are conveyed to the imaging station 160.

The imaging station 160 is operable to scan each document to obtain image data for each document. The image data is then exported and stored so that the image can be retrieved for subsequent processing of the document or archived for later referral. The imaging station may include one or more line scan cameras for scanning the documents. However, in the present instance, the imaging station 160 comprises one or more contact image sensors. The contact image sensors include a linear array of sensors and LED lights that illuminate and scan the documents to obtain image data. In the present instance, the imaging station includes a pair of contact image sensors for scanning both sides of a document to obtain image data of both the front and back of the documents.

After the documents are scanned at the imaging station 160, the documents are conveyed along the document transport 150. to one or more output bins. In the present instance, the imaging/sorting module 80 also includes one or more printers 170, 172 for printing information, such as the date, time, MICR number and/or a sequence number for each document.

After being processed, the documents are discharged into one or more output bins. In the present instance, the imaging/sorting module 80 includes a sorter 180 having a plurality of output bins 182, 184, 186. The documents may be sorted into the bins according to a variety of schemes. For instance, the documents may simply be sorted sequentially so that the documents are sorted to the first bin until it is full, at which time subsequent documents are directed to the second bin, and so on. Alternatively, the documents may be sorted according to data detected by analyzing the image data for one or more of the documents in a transaction.

The document transport 150 is configured to provide sufficient time to process the image data for each document in a transaction before any document in the transaction is sorted, so that the image data can be used as the basis for making sort decisions. Further, it may be desirable to print data on one or more of the documents based on data determined by analyzing the image data for one or more of the documents in a transaction. Accordingly, in the present instance, the document transport 150 is configured to provide sufficient time to process image data for each document in a transaction before the lead document in a transaction reaches the first printer 170.

As can be seen in FIG. 3, the length of the document transport between the discharge of the imaging station and the entry to the first printer 170 is approximately one half the width of the workstation or greater. In the following description, the section of the document transport 150 between the imaging station 160 and the first printer 170 is referred to as the delay section.

The first leg of the delay section extends from the imaging station 150 toward the sorter 180. The second leg of the delay section reverses direction, turning away from the sorter toward the opposite end of the imaging sorting module. The second leg of the delay section extends from adjacent the sorter to adjacent the opposite end of the imaging/sorting module (i.e. adjacent the right side of the imaging/sorting module from the perspective of FIG. 3). The third leg of the delay section again reverses direction turning back toward the sorter 180. The printers 170, 172 are positioned along the third leg of the document transport so that the documents pass the printers 170, 172 before entering the sorter 180. In this way, the document transport includes a delay section that follows a convoluted path of overlapping transport sections to increase the length of the document transport between the imaging station 160 and the printer 170, 172.

Alternatively, or in addition to incorporating a convoluted delay section, the imaging/sorting module may be extended in one or more directions to increase the length of the delay section. For instance, the imaging/sorting module may be extended rearwardly to provide sufficient space to allow an additional leg of the document transport to run along the back edge of the imaging/sorting module. In such a configuration, the delay section extends along substantially the entire width of the imaging/sorting module. The delay section may then reverse along the back edge of the imaging/sorting module to transport the documents back to the printers 170, 172, or the printers may be moved. Yet another alternative to is extend the imaging/sorting module to the left (from the perspective of FIG. 3), thereby providing more room to accommodate a longer pathway for each of the legs of the convoluted pathway described above. In this way, the extended length of the document transport 150 provides processing time to analyze the image data for a document or transaction so that the system may determine information about a document that is used to make sort decisions at the sorting station.

Method of Operation

Configured as described above, the present system 10 provides for the efficient extraction and imaging of documents that are contained within envelopes. To process a batch of mail, the mail is stacked into the input bin 20 of the envelope feeder. A feed arm feeds the envelopes one at the time to a feed tray 40. From the feed tray, the envelope is conveyed past one or more cutters for cutting open one or more edge of the envelope. A horizontal transport 50 then conveys the opened envelope to an extraction station 60. At the extraction station one or more moveable extraction arm engages one or more faces of the envelope to pull apart the faces of the envelope to present the contents of the envelope to the operator. The operator unfolds the documents if necessary and determines whether the documents are suitable for being scanned. If the operator determines that the documents are not suitable for scanning, the operator places the documents into one of several bins 190. For instance, if the documents are ripped or too large to be accommodated by the document transport, the documents may be placed into one of the bins 190.

If the operator determines that the documents are suitable for imaging, the operator places the documents into the input bin 100 of the imaging/sorting module 80. The system is operable to track the documents to maintain transactional boundaries. Specifically, the system is operable to associate the documents from an envelope with each other. For example, if an envelope contains a check and an invoice stub, the system is able to track the check and document as they progress through the imaging/sorting module 80 so that the two documents and/or the image data for the documents are correlated to one another.

To ensure that the documents from one transaction are not associated with the documents from a different transaction, in the present instance, the operator waits until all of the documents from a transaction are fed out of the input bin before the operator places a subsequent transaction into the document input bin 100. The system may include an indicator to provide a signal to the operator that the input bin is clear so that a transaction may be placed into the input bin. In the present instance, the configuration of the input bin allows the documents themselves to operate as the signal to the operator. For instance, referring to FIG. 6, the input bin is configured so that the operator can see the documents in the document input bin. Therefore, if the operator sees a document in the input bin the operator does not feed another transaction into the input bin.

If the document input bin 100 is empty, the operator drops a transaction into the bin. The operator drops the documents into the bin by inserting the documents in an edge first orientation into the chute between the front wall 102 and the rear wall 104. In this way, the documents are oriented in a generally vertical or on edge orientation in the input bin, as opposed to being face down in a generally horizontal orientation. More specifically, the documents typically are rectaungular, so that they are longer in one direction, such as having a height that is greater that its width. The documents are placed into the bin in a generally vertical orientation with the longer edge of the documents downward (i.e. the documents are in a landscape orientation rather than a portrait orientation).

In the present instance, the rotatable brush 130 runs constantly, but the horizontal feed belt 120 runs intermittently. Specifically, the bottom belt is stopped when the input bin is empty. A document detector 109 detects the presence of documents in the input bin when the operator drops the documents into the input bin. The horizontal belt 120 may commence as soon as the document detector detects the presence of a document in the input bin. However, in the present instance, the system waits or delays the start of the feed belt. Specifically, the controller that controls the operation of the feed belt waits a pre-determined time after receiving the signal from the document detector indicating that a document was dropped into the input bin.

The brush 130 rotates constantly rather than running intermittently as the feed belt 120. Therefore, during the delay period after a document is dropped into the input bin, the rotating brush 130 urges the documents in a transaction downwardly toward the horizontal belt. After the delay period, the feed belt 120 drives the documents forwardly toward the singulator 140.

The singulator 140 serially feeds the documents to the system transport 150, which serially conveys the documents to the MICR station 158, imaging station 160 and printers 170, 172. The sorter 180 then sorts the documents into one or more output bins.

Image Processing

During the processing of the documents, images of the documents are obtained, the document-type for each document may be determined (i.e. whether the document is a check or an invoice), the image data may be analyzed to determine the OCR line for invoices, and the MICR reader may read the MICR line for checks. Based on the data determined for the documents in a transaction, the apparatus is operable to perform a wide variety of analyses to determine further information about each document in a transaction and/or about the transaction. After making the determination, the documents may be sorted in the sorter 180 according to the determination, as discussed further below.

One type of processing that can be done for the documents is to attempt to automatically read the check amount so that the check amount does not need to be keyed in later by an operator. One method for determining the check amount is to perform a courtesy amount read/legal amount read analysis, referred to as a CAR/LAR analysis, in which the image data for the check is analyzed to read the check amount.

During the CAR/LAR analysis, the image data for a check is analyzed to identify the portion of the image data that includes the courtesy amount and the portion that includes the legal amount. Since the checks may be either handwritten or machine written, a variety of pattern matching techniques may be utilized to attempt to identify the characters in the courtesy amount portion of the document and the characters in the legal amount portion of the document.

If the CAR/LAR analysis is able to read both the courtesy amount and the legal amount, and the two amounts match, it may be presumed that the check amount was properly determined. The transaction is then identified as having a check amount determined and may be sorted separately in the sorter 180. For instance, all of the checks that have had the check amount determined may be directed to a particular bin. The documents can then bypass the check amount determination procedure during subsequent document processing.

Image Verification

Another analysis that can be performed prior to sorting the documents is an image quality check, particularly for the checks. With the advent of CHECK 21 procedures, a replacement check can be used during the check clearing process, rather than the paper document. The replacement check is produced using scanned images of the check. Since the image may be used rather than the paper document, it is important to ensure that the scanned image meets certain image quality standards.

Accordingly, prior to sorting a check in the sorter 180, the image data for the check may be analyzed to determined whether the image meets image standards that must be met to clear the check using the image rather than the paper copy. During the quality check analysis of the image data, various characteristics may be analyzed. For instance, the image data may be analyzed to ensure that: (1) the image is neither too light nor too dark; (2) the image is not excessively skewed; (3) the image is a complete image; (4) the image does not contain streaks or bands (either light or dark); and (5) that the image size is neither above a maximum image size nor below a minimum image size.

If the analysis of the check image indicates that the quality of the image is not sufficient for use in an automated or truncated clearing procedure, the check and/or the transaction may be electronically tagged and sorted separately from checks/transactions that do meet the image quality criteria. In addition, the data regarding the check image quality may be added to the data record for the check and/or transaction.

Database Look-Up

In addition to the processes discussed above, data regarding a document or transaction may be used to determine other information about the document or transaction through the operation of one or more database look-up procedures. The information identified during the database look-up may then be used to determine how to sort the document or transaction.

For instance, it may be desirable to separate transactions or documents based on the customer account. More specifically, a company may desire to separate payments that are received from certain customers. For instance, it may be desirable to separate customer accounts that have a history of providing checks that are returned for insufficient funds. Therefore, before the transaction is sorted in the sorter 180, the customer account number (as determined by the OCR line on the invoice) is compared against a database of accounts to be flagged. If the account number matches an account on the list, the check and/or transaction is electronically tagged and sorted separately in the sorter 180.

Similarly, it may be desirable to determine whether a transaction qualifies for processing the check using an ARC/ACH procedure that converts the check payment into an electronic payment. To identify transactions that are eligible for ARC conversion, both the OCR line from the invoice and the MICR line from the check may be utilized.

In the foregoing discussion, the documents are described as being physically separated into different bins. Similarly, the images of the documents can be sorted and separated according to the same criteria discussed above. Additionally, in certain applications, it may be desirable to electronically sort the image data for the documents according to the criteria discussed above rather than physically separating the documents as described above. Further still, it may be desirable to sort the physical documents in one manner, while sorting the image data according to different criteria.

Connectivity with Remote Processors

In the previous discussion a number of analyses are described for processing data regarding the documents to make certain determinations. In the present embodiment, the apparatus is configured with a readily connectable interface to allow the system 10 to interconnect with a number of modules designed to make one of the various determinations discussed above, particularly with respect to determinations made based on the scanned images of the documents and the MICR read.

The architecture of the system operates under a client/server model. The system 10 operating as a client, sends a request to a server. Referring to the CAR/LAR process for example, a request is made to the CAR/LAR module to analyze the image data for a check. Within a certain period of time, the CAR/LAR module returns a result (check amount, indeterminate or otherwise) to the operation computer. While the CAR/LAR module processes the image data, another request may be made to the CAR/LAR module for a subsequent check. Rather than responding in real time (i.e. before the subsequent response is made), the CAR/LAR module queues the requests and returns the responses in the future, within the predetermined period. When the response is returned, the operation computer associates the response with the relevant documents. A sort decision can then be made if desired, or the operational computer can make the decision later after receiving responses that may have been made for the document or transaction.

By using such an interface, a number of connections can be made with a variety of servers, local or remote. Each of the servers operates independently to provide the request from the client. The interface provides the communication gateway so that each of the remote modules operating as servers can communicate with the operations computer. If a module is on a remote machine, the interface allows the client and server to communicate between the remote systems. If the module is on a local machine (e.g. the operational computer), the interface allows the client to communicate directly with the module.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

The invention claimed is:

1. A document processing apparatus, comprising of:

an envelope feeder having an input for receiving a stack of envelopes containing contents, wherein the envelope feeder is operable to serially feed envelopes from the stack;

an opening station operable to receive envelopes from the envelope feeder and open the envelopes along one or more edges;

an extraction station for receiving the envelopes from the opening station and pulling apart the faces of the envelope to present the contents to an operator so that the operator can manually remove the contents from an envelope;

a document input bin positioned adjacent the extraction station, wherein the input bin comprises a forward vertical wall and a rearward vertical wall spaced apart from the forward wall, forming an enlarged feed slot for receiving extracted contents in a generally vertical orientation;

a generally horizontal feed conveyor at least part of which is positioned between the forward wall and the rearward vertical wall of the input bin, wherein the feed conveyor is configured to receive the extracted envelope contents in an on edge orientation, such that the bottom edge of the contents contacts the feed conveyor;

an element for urging the contents in the document input bin downwardly toward the feed conveyor wherein one of the forward wall and the rearward wall of the document input comprises a vertically elongated opening and the element for urging the contents downwardly projects through the vertically elongated opening;

a document feeder for receiving contents from the feed belt and separating the contents into a serial stream of documents; and an imaging station for receiving documents from the document feeder and scanning the documents to obtain image data for the documents.

2. The apparatus of claim 1 wherein the element for urging the contents downwardly comprises a plurality of displaceable fingers for engaging the contents.

3. The apparatus of claim 2 wherein the fingers are resiliently deformable.

4. The apparatus of claim 1 wherein the element for urging the contents downwardly is displaceable and has a plurality of elongated bristles.

5. The apparatus of claim 4 wherein the element for urging is rotatable.

6. The apparatus of claim 1 comprising a sensor for detecting the presence of documents in the document input bin, and a controller for controlling operation of the feed conveyor, wherein the controller delays actuation of the feed conveyor for a delay period after receiving a signal from the sensor indicative of one or more documents being placed into the input bin.

7. A document processing apparatus cooperable with a mail extraction workstation having an envelope feeder operable to serially feed envelopes from a stack, an opening station operable to open the envelopes along one or more edges, and an extraction station for receiving the envelopes from the opening station and pulling apart the faces of the envelope to present the contents to an operator so that the operator can manually remove the contents from an envelope, wherein the document processing apparatus comprises:

a document input bin comprising a forward vertical wall and a rearward vertical wall spaced apart from the forward wall, forming an enlarged feed slot for receiving documents in a generally vertical orientation;

a generally horizontal feed belt at least part of which is positioned between the forward wall and the rearward vertical wall of the input bin, wherein the feed belt is configured to receive the envelope contents in an on edge orientation, such that the edges of the contents contact the feed belt;

an element for urging the contents downwardly toward the feed belt wherein one of the forward wall and the rearward wall of the document input comprises a vertically elongated opening and the element for urging the contents downwardly projects through the vertically elongated opening;

a document feeder for receiving contents from the feed belt and separating the contents into a serial stream of documents; and an imaging station for receiving documents from the document feeder and scanning the documents to obtain image data for the documents.

8. The apparatus of claim 7 comprising a frame supporting the document input bin, document feeder and imaging station as a separable, independent unit, and a connector for connecting the frame to the mail extraction workstation.

9. The apparatus of claim 7 wherein the element for urging the contents downwardly comprises a plurality of displaceable fingers for engaging the contents.

10. The apparatus of claim 9 wherein the fingers are resiliently deformable.

11. The apparatus of claim 7 wherein the element for urging the contents downwardly comprises a displaceable brush having a plurality of elongated bristles.

12. The apparatus of claim 11 wherein the brush is rotatable.

13. The apparatus of claim 7 comprising a sensor for detecting the presence of documents in the document input bin, and a controller for controlling operation of the feed belt, wherein the controller delays actuation of the feed belt for a delay period after receiving a signal from the sensor indicative of one or more documents being placed into the input bin.

* * * * *